US010770204B2

(12) United States Patent
Kloiber et al.

(10) Patent No.: US 10,770,204 B2
(45) Date of Patent: Sep. 8, 2020

(54) ELECTRICAL DEVICE WITH SOLDERED JOINT

(71) Applicant: TDK Electronics AG, Munich (DE)

(72) Inventors: Gerald Kloiber, Feldkirchen (AT); Heinz Strallhofer, Deutschlandsberg (AT)

(73) Assignee: TDK Electronics AG, Munich (DE)

( * ) Notice: Subject to any disclaimer, the term of this patent is extended or adjusted under 35 U.S.C. 154(b) by 0 days.

(21) Appl. No.: 16/611,294

(22) PCT Filed: Jul. 12, 2018

(86) PCT No.: PCT/EP2018/068999
§ 371 (c)(1),
(2) Date: Nov. 6, 2019

(87) PCT Pub. No.: WO2019/016076
PCT Pub. Date: Jan. 24, 2019

(65) Prior Publication Data

US 2020/0066428 A1 Feb. 27, 2020

(30) Foreign Application Priority Data

Jul. 20, 2017 (DE) ..... 10 2017 116 381

(51) Int. Cl.

| | |
|---|---|
| ***H01C 1/144*** | (2006.01) |
| ***H01C 1/14*** | (2006.01) |
| ***H01C 17/28*** | (2006.01) |
| ***H01R 4/02*** | (2006.01) |
| ***H01R 4/62*** | (2006.01) |

(52) U.S. Cl.
CPC ..... *H01C 1/144* (2013.01); *H01C 1/1413* (2013.01); *H01C 17/281* (2013.01); *H01R 4/023* (2013.01); *H01R 4/625* (2013.01)

(58) Field of Classification Search
CPC ..... H01C 1/144; H01C 1/1413; H01C 17/281
See application file for complete search history.

(56) References Cited

U.S. PATENT DOCUMENTS

| | | | | |
|---|---|---|---|---|
| 3,793,604 A | | 2/1974 | Duggan et al. | |
| 4,827,634 A | * | 5/1989 | Tanabe | H01G 4/228 361/306.1 |
| 5,117,089 A | * | 5/1992 | Honkomp | F24H 1/202 219/201 |
| 5,557,251 A | * | 9/1996 | Takaoka | H01C 7/02 338/22 R |
| 6,150,918 A | * | 11/2000 | Berger | H01C 1/014 338/22 R |

(Continued)

FOREIGN PATENT DOCUMENTS

| | | |
|---|---|---|
| DE | 102014110553 A1 | 1/2016 |
| EP | 2296430 A2 | 3/2011 |

(Continued)

*Primary Examiner* — Kyung S Lee
(74) *Attorney, Agent, or Firm* — Slater Matsil, LLP

(57) ABSTRACT

An electrical device with a soldered joint is disclosed. In an embodiment, an electrical device includes at least one soldered joint having a first wire soldered at one end to the device, wherein the first wire bears with a bearing surface on the device, and wherein the first wire has at least one bend in a region of the bearing surface of the first wire on the device.

13 Claims, 1 Drawing Sheet

(56) References Cited

U.S. PATENT DOCUMENTS

| | | | | |
|---|---|---|---|---|
| 6,177,857 | B1 * | 1/2001 | Inoue | H01C 1/14 338/22 R |
| 7,075,407 | B1 * | 7/2006 | Kawamoto | G01K 1/14 338/22 R |
| 7,148,785 | B2 * | 12/2006 | Becker | H01C 1/016 338/22 R |
| 7,164,341 | B2 * | 1/2007 | Katsuki | H01C 1/1406 338/22 R |
| 7,193,498 | B2 * | 3/2007 | Kawamoto | G01K 1/14 338/22 R |
| 10,488,062 | B2 * | 11/2019 | Quam | H04W 4/021 |
| 10,534,331 | B2 * | 1/2020 | Quam | F24F 11/62 |
| 2012/0026659 | A1 | 2/2012 | Kim et al. | |
| 2017/0162303 | A1 | 6/2017 | Strallhofer et al. | |

FOREIGN PATENT DOCUMENTS

| | | | |
|---|---|---|---|
| JP | H01268108 | A | 10/1989 |
| JP | 2011129781 | A | 6/2011 |
| WO | 0186664 | A1 | 11/2001 |

* cited by examiner

ELECTRICAL DEVICE WITH SOLDERED JOINT

This patent application is a national phase filing under section 371 of PCT/EP2018/068999, filed Jul. 12, 2018, which claims the priority of German patent application 102017116381.6, filed Jul. 20, 2017, each of which is incorporated herein by reference in its entirety.

TECHNICAL FIELD

The present invention relates to an electrical device comprising a soldered joint and a wire fastened thereto.

BACKGROUND

An electrical device specifically has at least one contact surface, to which a wire is fastened by means of a soldered joint. In known devices, this wire is flattened at the end to be soldered, to make the device easier to hold during dip-soldering. As a result of this flattening, however, less solder collects at the contact point between device and wire. This frequently results in void or cavity formation. The small quantity of solder together with void formation has a negative impact on the strength of the soldered joint.

SUMMARY OF INVENTION

Embodiments provide an improved stability of a soldered joint between an electrical device and a wire.

In various embodiments an electrical device is proposed which comprises at least one contact surface and a soldered joint located thereon, with which a wire is fastened. This wire has a bearing portion at its end with which it bears on the device, and at least one bend at the end of the bearing portion.

This bearing portion is selected to be shorter than the contact surface of the electrical device. The bend and thus the bearing portion are followed by a portion in which the wire forms an angle $\alpha$ of 10° to 90° with the contact surface. An angular range of 45° to 90° or a smaller angular range of 60° to 90° is preferably selected. As a result of the intended shorter bearing portion and the bend, during soldering-on of the wire improved solder wetting of the wire is achieved in a wire portion with a gap relative to the contact surface. This leads to a greater quantity of solder and thus also to improved stability of the soldered joint.

The wire may have a flattened portion at its fastened end, the portion being distinguished by a rectangular to oval wire cross-section. The flattened portion is distinguished in that, as the wire continues away from its end, it develops into its original non-flattened cross-section. Such flattening of the wire results in a greater bearing surface of the wire on the device, which in comparison with a round cross-sectional shape enables improved hold of the device during the soldering process. The disadvantage of such flattening, however, lies in the smaller quantity of solder which is able to collect between the contact point and the flattened wire during soldering. Frequently, formation of cavities or voids in the solder may be observed in these regions. The small quantity of solder and the formation of voids at the contact point may have a negative impact on the stability of the soldered joint. This is again compensated with the bend after the bearing surface.

The flattened end of the wire may be rounded at all its corners and edges, in both a horizontal and a vertical sectional view, in order to ensure uniform distribution of the solder. The bend and optionally a second bend arranged further along the wire or indeed further bends may also have a rounded shape and not be sharply bent. The rounded portions enable the solder to flow around the entire contact point better than if the flattened portion of the wire were to have sharp corners.

For better contacting, a contact surface of the electrical device on which a soldered joint is produced may be coated with silver or another electrically conductive metal. Such a coating may be applied to the device using a screen printing method. Coating of a contact surface with an electrically conductive metal enables a better electrical connection with a soldered-on element such as in particular the stated wire.

The flattened portion of the wire is in general of any desired length and may extend from the fastened end of the wire or from the bearing surface to beyond the above-described bend. The bend may be arranged at the end of the flattened portion.

When viewed from the soldered end, the wire may have a further bend after the first. It may be left open whether the further bend is still in the region of the flattened portion or at the limit thereof. The further bend results in a change in the angle between the contact surface and the wire as the wire continues, if the profile of the wire is otherwise assumed to be largely straight. The new angle lies in a range of 0° to 80°. The angular range may also extend from 0° to 45° or in the preferred case from 0° to 20°. A further bend in the wire may result in a region between the contact surface of the electrical device and the soldered wire in which the wire is located with a variable gap above the contact surface.

The presence of such a gap may prove advantageous for the stability of a soldered joint, if wetting with solder arises there. An increased amount of solder may collect in the region of the wire where it extends with a variable gap above the contact surface. The resultant larger amount of solder may have a positive effect on the stability of the soldered joint.

As it continues away from the solder point, after the further bend, the wire may be provided with insulation. Beginning from a variable gap after the further bend, the wire may have insulation consisting of a synthetic polymer material, which may extend over the remaining length of the wire. Insulation of the wire prevents undesired electrical contact with further contact points on the device or with other electrically conductive elements and thereby also prevents short-circuiting between two wires. In this way, the functionality of the device is not disturbed.

In one specific example, the device may comprise an NTC ceramic as its main body. This may take the form of a cut chip or a pressed wafer, which is based on spinel or perovskite ceramics. The wire is soldered onto a contact surface of this main body.

In addition to the described wire, a further wire may also be soldered onto the device. This further wire may have the same features as the wire already described. It is however also possible for every above-explained characteristic or property of the wire or contact point to differ from the above embodiment.

The device, comprising all the existing solder points and parts of the wires, may be provided with a polymer covering, for example of an epoxide. The shape of the covering may resemble a droplet, which encloses the wire or wires up to a given length. Such a covering is capable of protecting the device and the solder point or solder points from mechanical loading and/or from environmental influences, such as moisture.

BRIEF DESCRIPTION OF THE DRAWINGS

Preferred exemplary embodiments of the present invention are described below with reference to the figures.

DETAILED DESCRIPTION OF ILLUSTRATIVE EMBODIMENTS

Figure 1:
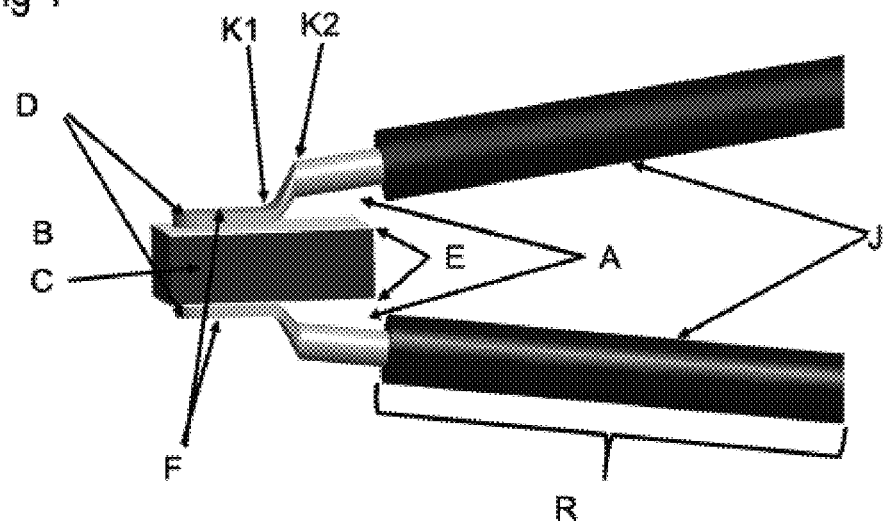
FIG. 1 shows a perspective view of an NTC ceramic with two wires at opposing contact points.

FIG. 1 is a perspective representation of a preferred embodiment of an electrical device B. Two opposing contact surfaces E on a main body of an NTC ceramic C are coated with silver. A wire with its flattened portion F or with its flattened bearing surface rests against each of these contact surfaces E. A first bend K1 is present in the wires in the region of the flattened portion F. The length of the flattened wire portions, which constitute the bearing surface, bearing on the contact surfaces, i.e., the length of the respective wire end D up to the first bend, is selected to be smaller than the contact surface of the device. In this respect, the wire end D lies close to one edge of the contact surface E, such that the wire has a further portion M to O which extends above the contact surface E. After this first bend K1 the wires, which are still flattened in this portion, extend at an angle of about 60° to the contact surface E away from the ceramic body C. At the end of the flattened portion F the wires develop into a region R with a round cross-sectional shape. In addition, the wires have a second bend K2 at the end of their flattened portion F. The second bend is angled in the opposite direction to the first, such that the wires continue at a smaller, more acute angle of about 10° to the contact surface. The gap A between this region of round cross-section R and the contact surface E may fill up with solder during the soldering process and leads to increased stability of the soldered joint. As the wires continue, they are provided with insulation J consisting of a polymer material.

Figure 2:
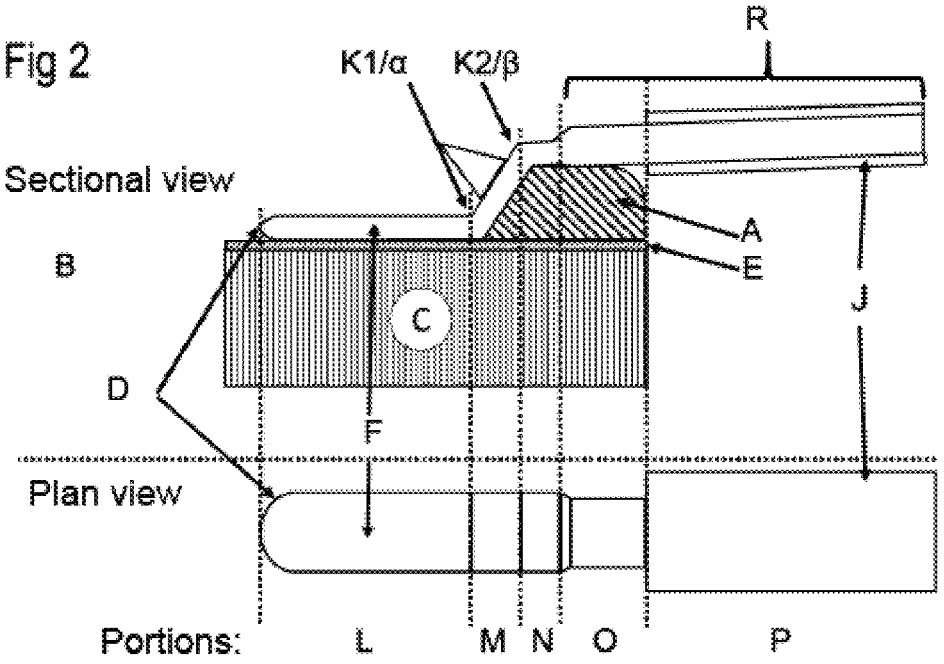
FIG. 2 shows a device together with wire in sectional view and plan view.

FIG. 2 shows a schematic cross-section of the electrical device B with a wire, and a plan view onto the wire. The contact surface E shown of an NTC ceramic C is coated with silver. A wire rests with its flattened portion F on this contact surface E. On its flattened side, the wire has a rounded end E. In the region of the flattened portion F a first bend K1 is present in the wire, forming the angle $\alpha$. The length of the flattened wire portions L bearing on the contact surfaces, i.e., from the end of the wire up to its first bend K1, is selected to be smaller than the contact surface E of the device. After this first bend K1 the flattened wire extends at an angle $\alpha$ of about 60° to the contact surface E away from the ceramic body C. After the wire has moved away from the ceramic over the course of portion M, it has a further bend K2. In the following portions N-P the wire extends at the angle $\beta$ to the contact surface E, wherein $\beta<\alpha$. At the end of the portion N the wire develops into the region O of round cross-sectional shape R. The volume in the region of the gap A between the portions N and O and the contact surface E may fill up with solder during the soldering process and leads to increased stability of the soldered joint. Over the course of the portion P, the wire is provided with a polymer insulation J.

The invention relating to the electrical device with soldered joint is not limited to the exemplary embodiments explained or the figures shown.

The invention claimed is:

1. An electrical device comprising:

at least one soldered joint comprising a first wire soldered at one end to the device, wherein the first wire bears with a bearing surface on the device, wherein the first wire has at least one bend in a region of the bearing surface of the first wire on the device, and wherein the bearing surface of the first wire has a rounded end in plan view.

2. The device according to claim 1, wherein the first wire has a further bend in a region of a flattened portion which is directed towards a contact surface.

3. The device according to claim 1, wherein the first wire has a flattened portion in the region of the bearing surface.

4. The device according to claim 1, wherein the device has at least one contact surface for the soldered joint which is coated with an electrically conductive metal.

5. The device according to claim 4, wherein the bearing surface of the first wire is shorter than the contact surface.

6. The device according to claim 1, wherein the first wire extends after the bend with a gap relative to a contact surface when viewed from the bearing surface.

7. The device according to claim 6, wherein the soldered joint comprises a solder, a greater part of which is arranged in a region in which the first wire extends with the gap relative to the contact surface.

8. The device according to claim 1, wherein the bend is arranged in the first wire at an end of a flattened portion where it develops into a region of a round cross-sectional shape.

9. The device according to claim 8, further comprising a first wire insulation of a synthetic polymer material, which begins only in the region of round cross-sectional shape.

10. The device according to claim 1, wherein the device comprises an NTC ceramic.

11. The device according to claim 1, further comprising a polymer covering, which envelops the device, the soldered joint and the first wire to as far as behind a last bend.

12. The device according to claim 1, further comprising a second contact surface, to which a second wire identical in form to the first wire is soldered.

13. An electrical device comprising:

at least one soldered joint comprising a wire soldered at one end to the device, wherein the wire bears with a bearing surface on the device, wherein the wire has at least one bend in a region of the bearing surface of the wire on the device, wherein the wire has a flattened portion in the region of the bearing surface, and wherein the bend is arranged in the wire at an end of the flattened portion where it develops into a region of a round cross-sectional shape.

* * * * *